US006667734B2

(12) United States Patent
Furukawa et al.

(10) Patent No.: US 6,667,734 B2
(45) Date of Patent: Dec. 23, 2003

(54) JOY STICK

(75) Inventors: Hitoshi Furukawa, Tokyo (JP); Tetsuya Kifune, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 240 days.

(21) Appl. No.: 09/902,257

(22) Filed: Jul. 11, 2001

(65) Prior Publication Data

US 2002/0005833 A1 Jan. 17, 2002

(30) Foreign Application Priority Data

Jul. 13, 2000 (JP) ..... P.2000-212931

(51) Int. Cl.[7] ..... G09G 5/08
(52) U.S. Cl. ..... 345/161
(58) Field of Search ..... 345/161, 168, 345/156, 157, 167, 172; 200/6 A; 74/471 XY; 341/20; 338/128, 131

(56) References Cited

U.S. PATENT DOCUMENTS 6,353,430 B2 * 3/2002 Cheng et al. ..... 345/161
6,445,377 B1 * 9/2002 Shimomura ..... 345/161
6,538,639 B1 * 3/2003 Takahashi ..... 345/161

* cited by examiner

*Primary Examiner*—Regina Liang
(74) *Attorney, Agent, or Firm*—Whitham, Curtis & Christofferson, PC

(57) ABSTRACT

A first crank supports an operating stick so as to be pivotable in a first direction. First flat faces are formed at lower both end portions in the first direction of the first crank. A second crank supports the operating stick so as to be pivotable in a second direction which is perpendicular to the first direction. Second flat faces are formed at lower both end portions in the second direction of the second crank. A restoration member is arranged coaxially with the operating stick which is situated at a neutral position thereof. The restoration member includes a flat top face brought into contact with the first flat faces and the second flat faces. A spring member is arranged coaxially with the restoration member, and urges the restoration member toward the first flat faces and the second flat faces.

3 Claims, 8 Drawing Sheets

JOY STICK

BACKGROUND OF THE INVENTION

The present invention relates to a joy stick, and more particularly to the joy stick in which restoring accuracy of cranks arranged in a casing has been enhanced.

An example of a related joy stick of this type will be described referring to FIGS. 9 and 10. In the drawings, a joy stick 1 is composed of a base table 2, a helical spring 3 and a spring holder 4 mounted on the base table 2 in this order, a cam 5 received in a recess 4*a* formed on an upper face of the spring holder 4, and an operating stick 6 attached to the cam 5 at its lower part, and a box-like casing 7 which is open at its lower face and attached to the base table 2 at its lower end part.

In the casing 7, there is disposed a lower crank 8. Shafts 8*a* projecting from both ends of the lower crank 8 are rotatably engaged in axial bores which are formed in a left side plate 7*a* and a right side plate 7*b* of the casing 7.

The lower crank 8 is provided in its central area with a hole 8*b* through which the cam 5 is adapted to be idly inserted. A pin 9 is passed through the lower crank 8 and the cam 5 so that the lower crank 8 and the cam 5 can freely pivot in a direction of an arrow X around the pin 9. Therefore, the spring holder 4 is biased upward by the helical spring 3, and accordingly, the cam 5 and the lower crank 8 are always pressed upward by the spring holder 4.

Moreover, an upper crank 10 which perpendicularly intersects the lower crank 8 is disposed in the casing 7. Shafts 10*a* projecting from the upper crank 10 in a direction to the back and the forth in the drawing are rotatably engaged in axial bores (not shown) which are formed in a front side plate (not shown) and a back side plate 7*c* of the casing 7.

In a central area of the upper crank 10, there is formed a guide groove 10*b* in which the operating stick 6 is idly engaged so as to be pivotable in the direction of the arrow Y. In addition, a variable resistor 11 for detecting rotation angles of the lower clank 8 is provided on an outer face of the left side plate 7*a* of the casing 7. A rotary shaft (not shown) of the variable resistor 11 is coupled to the left hand shaft 8*a* of the lower crank 8.

In the same manner, a variable resistor (not shown) for detecting rotation angles of the upper clank 10 is provided on the back side plate 7*c* of the casing 7, and the variable resistor is coupled to one of the shafts 10*a* of the upper crank 10.

In the joy stick constructed in this manner, by operating the operating stick 6 in the direction of the arrow Y, the lower crank 8 is rotated as indicated by an arrow A, and the rotation angles are detected by the variable resistor 11 thereby controlling an object to be controlled.

Similarly, by operating the operating stick 6 in the direction of the arrow X, the upper crank 10 is rotated, and the rotation angles are detected by the variable resistor. In conducting these operations, when the operating stick 6 is tilted to the left, for example, as shown in FIG. 10, the spring holder 4 is pressed by the cam 5 which rotates along with the operating stick 6, and thus, the helical spring 3 will be compressed.

When the operating stick 6 in this state is released by an operator's finger, the operating stick 6 will be restored to a neutral position as shown in FIG. 9, along with the cam 5 by resilient restoring force of the helical spring 3. When the lower crank 8 is rotated by operating the operating stick 6 in the direction of arrow Y, the operating stick 6 will act in the same manner.

In addition to a problem of the above described joy stick 1 that the guide groove 10*b* of the upper crank 10 may be worn by repeated operations of the operating stick 6, but there is also a problem that the restored position of the upper crank 10 may change due to a backlash or a clearance between components in terms of accuracy, and the variable resistor 11 may not be accurately restored to the determined neutral position, resulting in inaccurate output of the control of the joy stick 1.

SUMMARY OF THE INVENTION

It is therefore an object of the present invention is to provide a joy stick which is excellent in restoring accuracy of the cranks to the neutral position and free from such confusion in the control.

In order to achieve the above object, according to the present invention, there is provided a joy stick, comprising:

an operating stick;

a first crank, which supports the operating stick so as to be pivotable in a first direction;

first flat faces, which are formed at lower both end portions in the first direction of the first crank;

a second crank, which supports the operating stick so as to be pivotable in a second direction which is perpendicular to the first direction;

second flat faces, which are formed at lower both end portions in the second direction of the second crank;

a restoration member, which is arranged coaxially with the operating stick which is situated at a neutral position thereof, the restoration member including a flat top face brought into contact with the first flat faces and the second flat faces; and a spring member, which is arranged coaxially with the restoration member, the spring member urging the restoration member toward the first flat faces and the second flat faces.

In this configuration, the restoration member is biased upward by the spring member, thus enabling the first crank and the second crank to be accurately restored to the neutral position. Therefore, irrespective of wear of the first crank and the second crank, the restoring accuracy of the first crank and the second crank can be maintained. At the same time, the number of the components will be decreased, thus attaining a low manufacturing cost.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
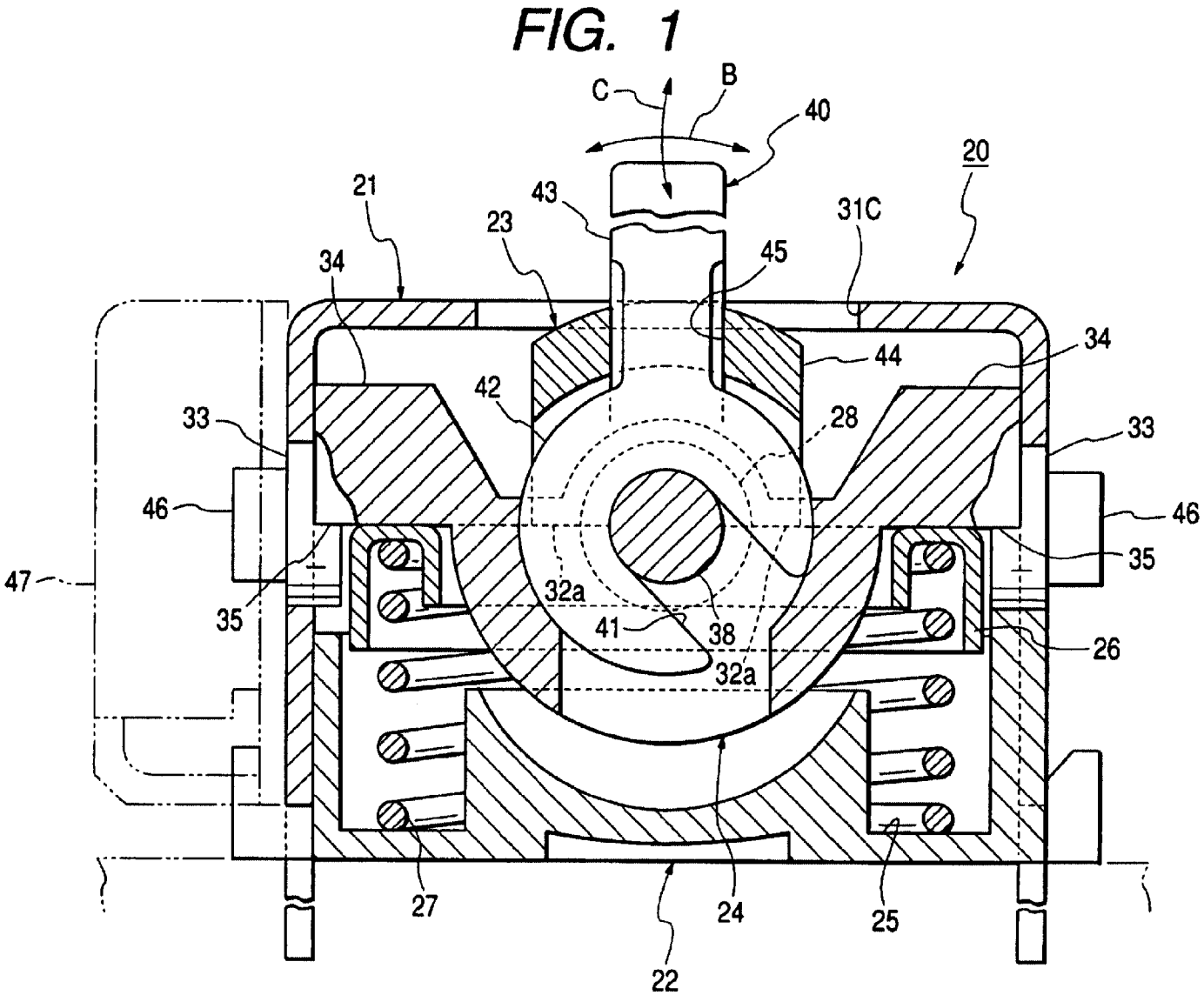
FIG. 1 is a longitudinal sectional view showing one embodiment of a joy stick according to the invention.
Figure 2:
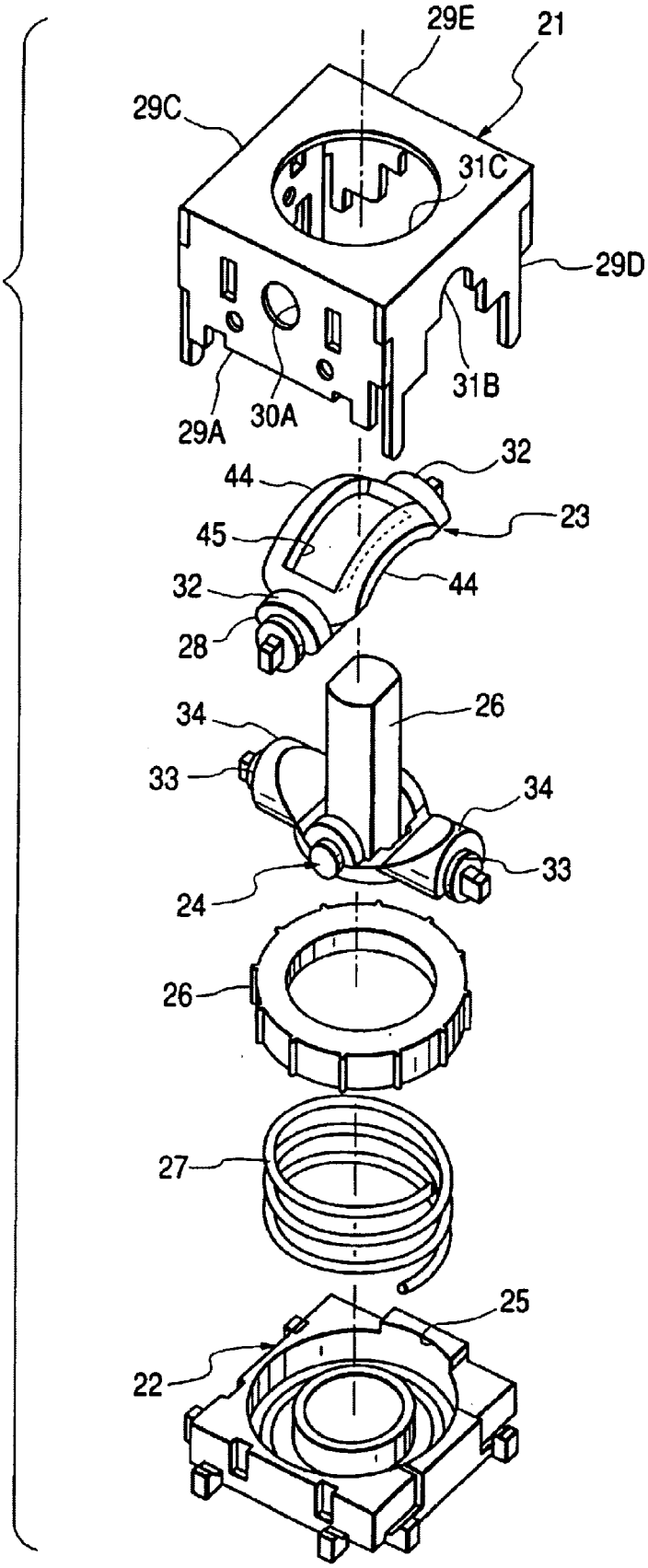
FIG. 2 is an exploded perspective view of the joy stick.

Now, one embodiment of the joy stick according to the invention will be described in detail referring to the accompanying drawings. As shown in FIGS. 1 and 2, a joy stick 20 includes a base table 22 fitted to an open side of a casing 21, a first crank 23 and a second crank 24 perpendicularly intersecting with each other and disposed in the casing 21. A spring holder 26 is pressure contacted to respective lower faces of opposite end parts of the first crank 23 and the second crank 24. A helical spring 27 is interposed between the spring holder 26 and a groove 25 formed in the base table 22 (see FIGS. 4A to 4F).

Figure 3:
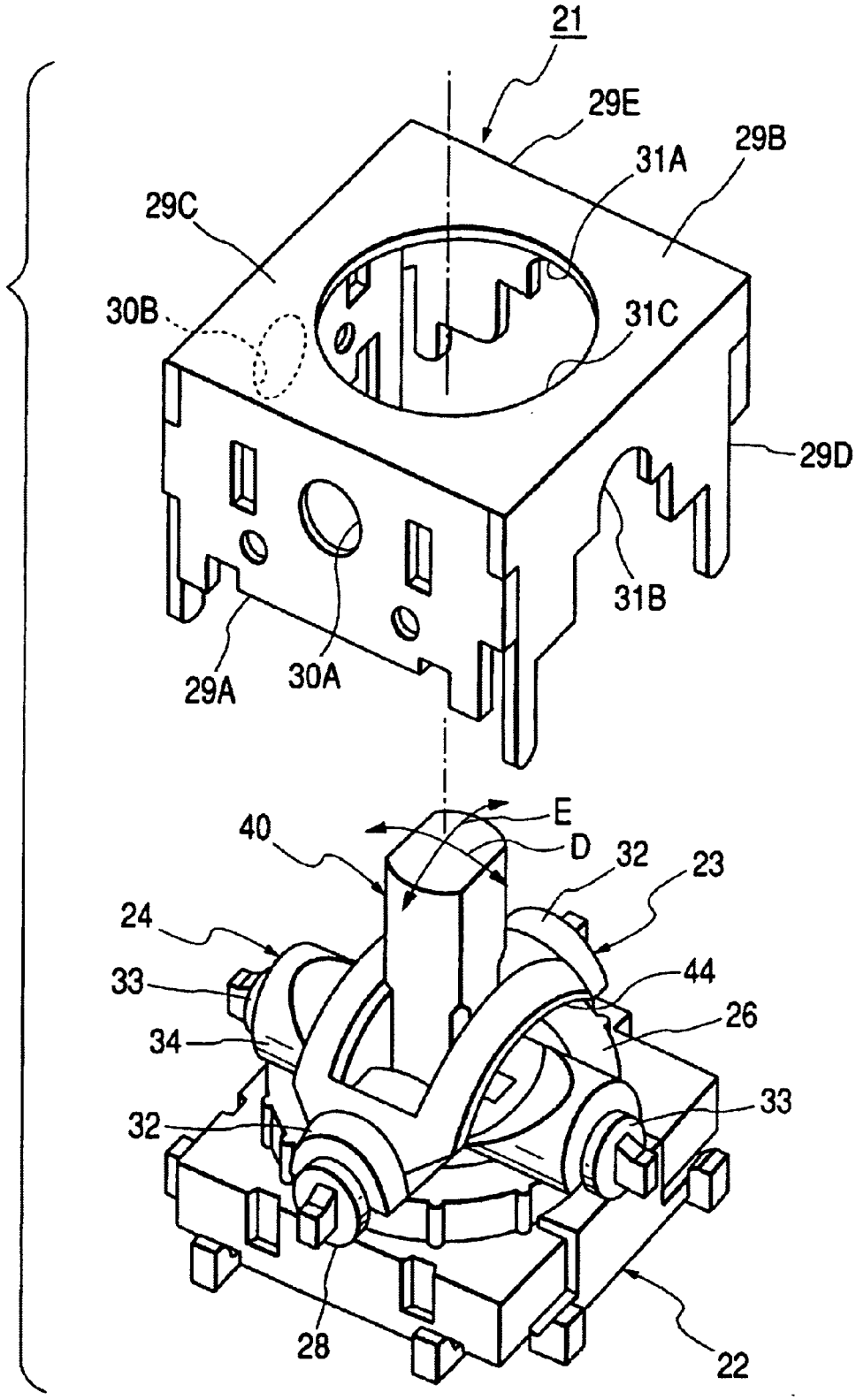
FIG. 3 is a partially-exploded perspective view of the joy stick.
Figure 4A:
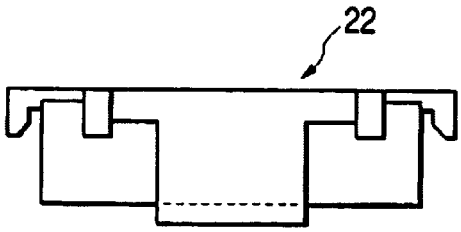
FIG. 4A is a back side view of a base table incorporated in the joy stick.
Figure 4B:
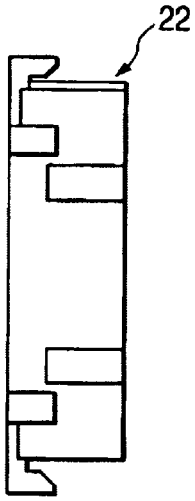
FIG. 4B is a left side view of the base table.
Figure 4C:
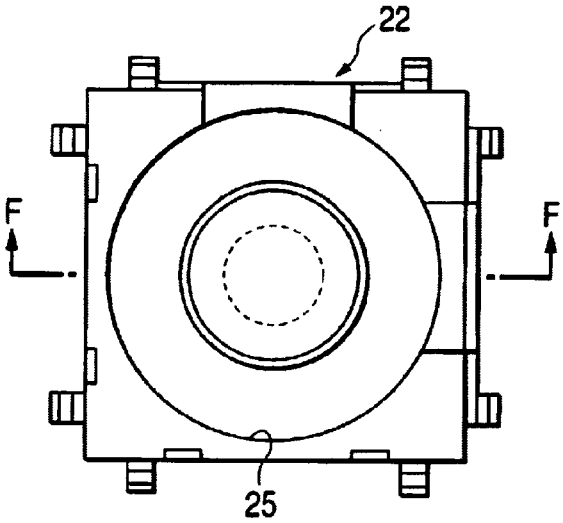
FIG. 4C is a plan view of the base table.
Figure 4D:
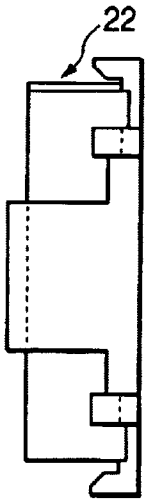
FIG. 4D is a right side view of the base table.
Figure 4E:
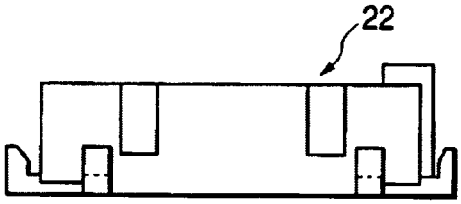
FIG. 4E is a front view of the base table.
Figure 4F:
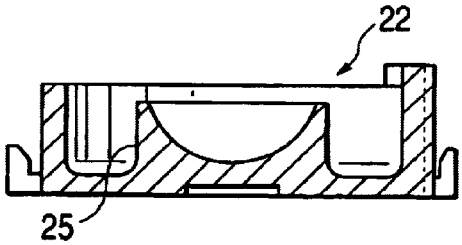
FIG. 4F is a sectional view taken along a line F—F of FIG. 4C.
Figure 5A:
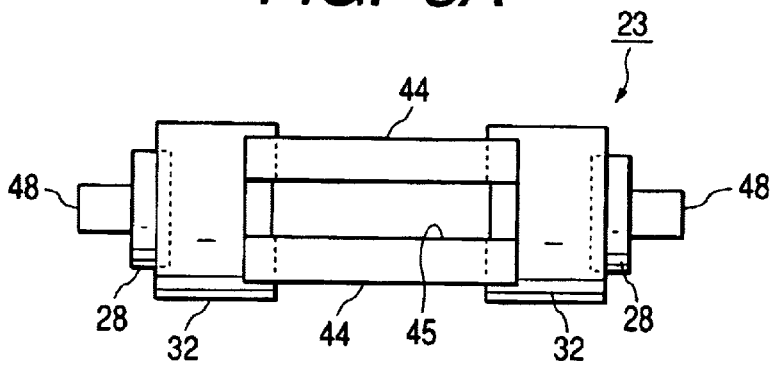
FIG. 5A is a plan view of a first crank incorporated in the joy stick.
Figure 5B:
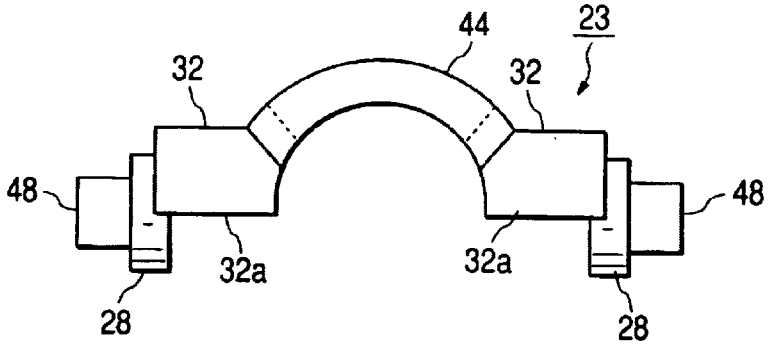
FIG. 5B is a front view of the first crank.

The first crank 23 has shafts 28 projecting from both ends thereof as shown in FIGS. 5A, 5B and SC and rotatably engaged in axial bores 30A, 31A formed in side plates 29A, 29B of the casing 21 as shown in FIG. 3. In the same manner, the second crank 24 has shafts 33 projecting from both ends thereof as shown in FIGS. 6A, 6B, 6C and 6D and rotatably engaged in axial bores 31B, 31B formed in left and right side plates 29C, 29D of the casing 21 as shown in FIG. 3.

Figure 7A:
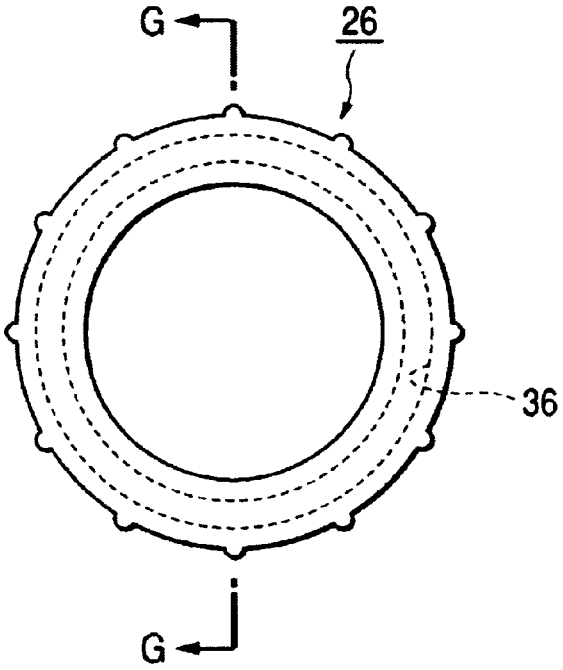
FIG. 7A is a detailed view of a spring holder incorporated in the joy stick.
Figure 7B:
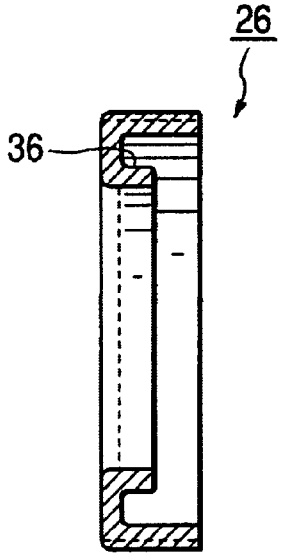
FIG. 7B is a sectional view taken along a line G—G of FIG. 7A.

The first crank 23 is further provided with arm portions 32 at base ends of the shafts 28, and flat face portions 32*a* are formed on lower faces of the arm portions 32. In the same manner, the second crank 24 is provided with arm portions 34 at base ends of the shafts 33, and flat face portions 35 are formed on lower faces of the arm portions 34. The spring holder 26 is resiliently abutted against these flat face portions 32*a,* 35 by means of the helical spring 27. Further, as shown in FIGS. 7A and 7B, an annular groove 36 is formed at a lower face of a circumferential part of the spring holder 26 to idly receive the helical spring 27.

Figure 8:
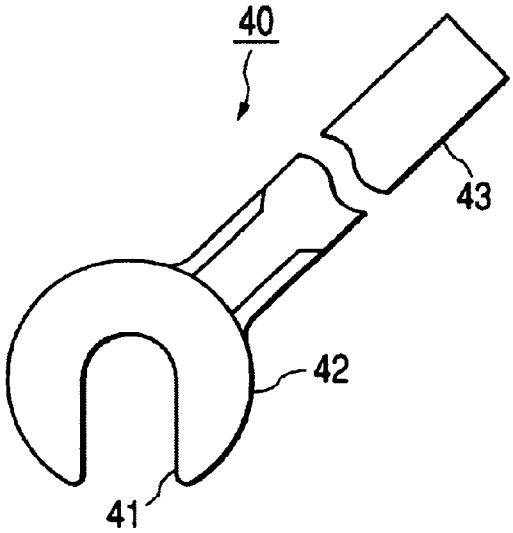
FIG. 8 is a detailed view showing an operating stick incorporated in the joy stick.
Figure 9:
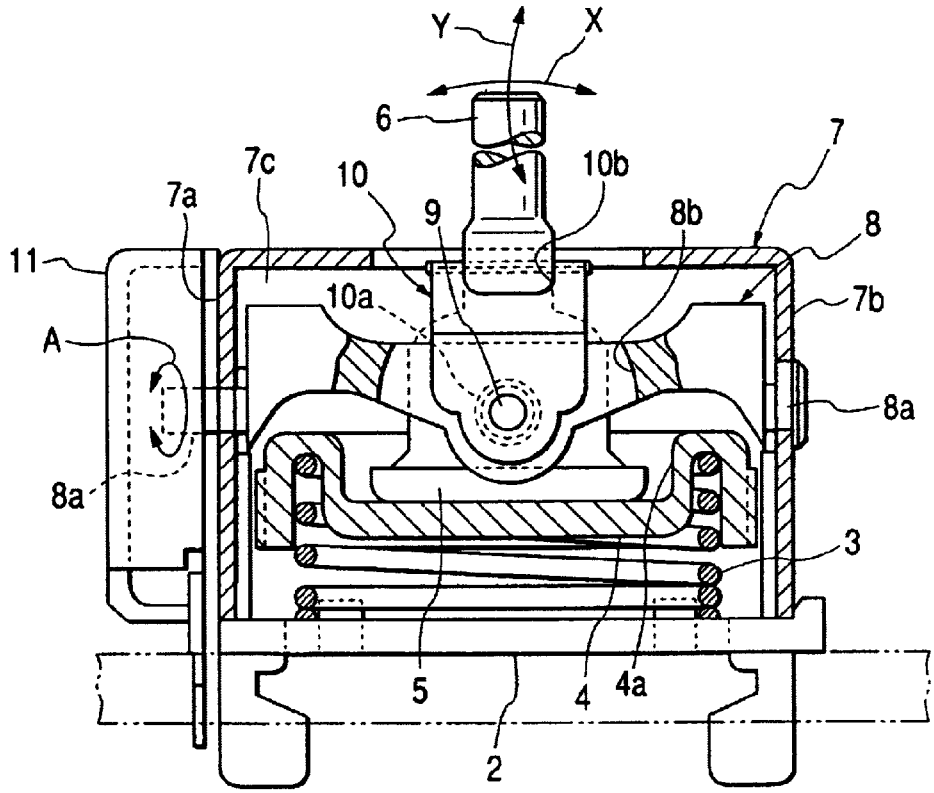
FIG. 9 (Related Art)
FIG. 9 is a longitudinal sectional view of a related joy stick.
Figure 10:
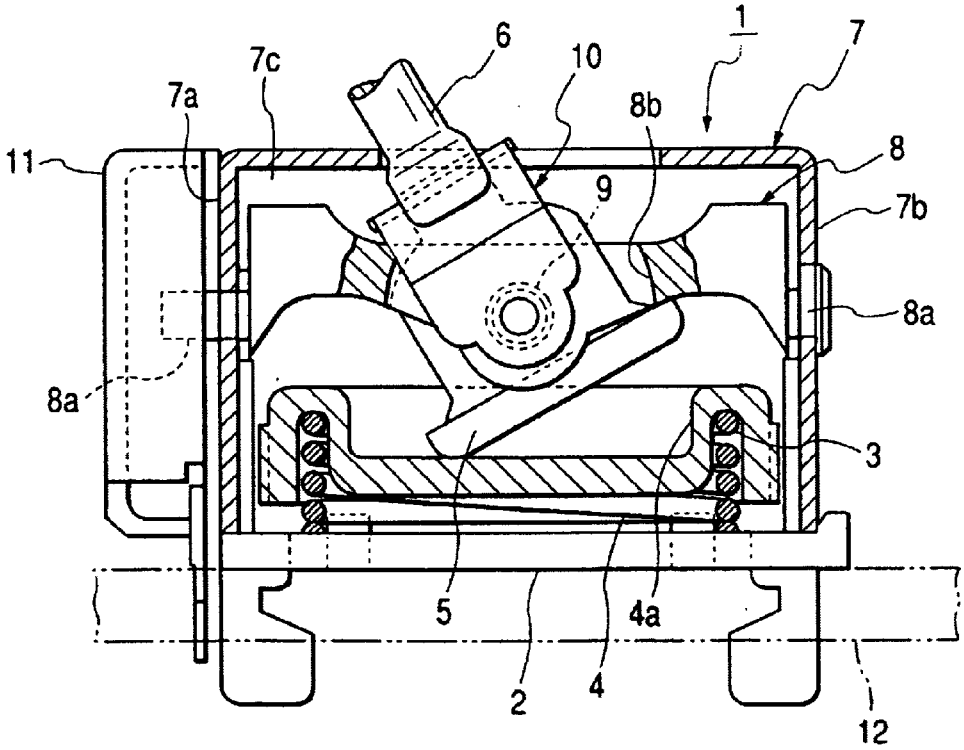
FIG. 10 (Related Art)
FIG. 10 is a longitudinal sectional view showing operation of the related joy stick.

As shown in FIGS. 6A to 6D, the second crank 24 is provided with a connecting portion 37 for coupling the arm portions 34. A shaft 38 is provided at a center of the connecting portion 37, and an arcuate groove 39 is formed around an outer circumference of the shaft 38. A groove 41 and a head 42 formed at a distal end of an operating stick 40 (see FIG. 8) are engaged with the shaft 38 and the groove 39, and at the same time, an arm portion 43 of the operating stick 40 passes through a guide groove 45 formed between guide portions 44 of the first crank 23, and projects upward through a stick hole 31 C formed in an upper plate 29 of the casing 21.

Figure 5C:
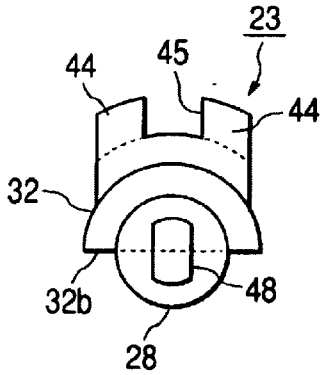
FIG. 5C is a right side view of the first crank.
Figure 6A:
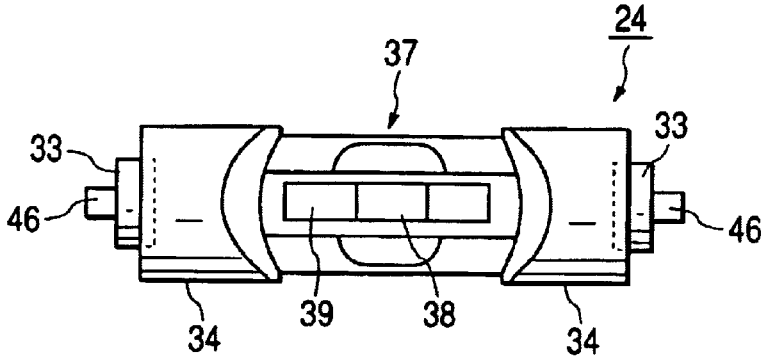
FIG. 6A is a plan view of a second crank incorporated in the joy stick.
Figure 6B:
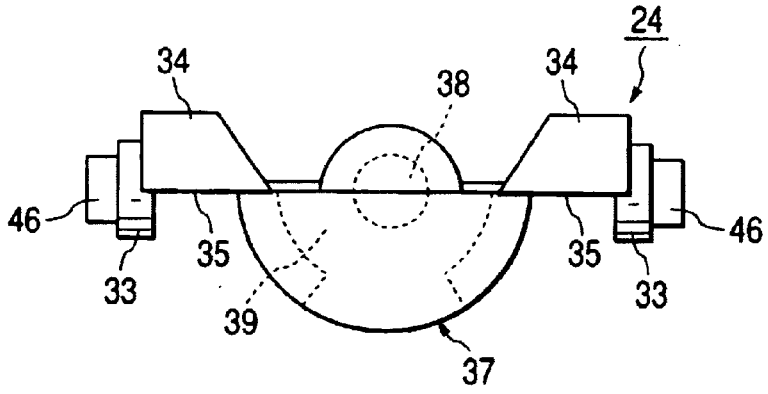
FIG. 6B is a front view of the second crank.
Figure 6C:
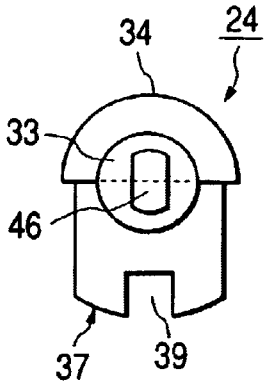
FIG. 6C is a right side view of the second crank.
Figure 6D:
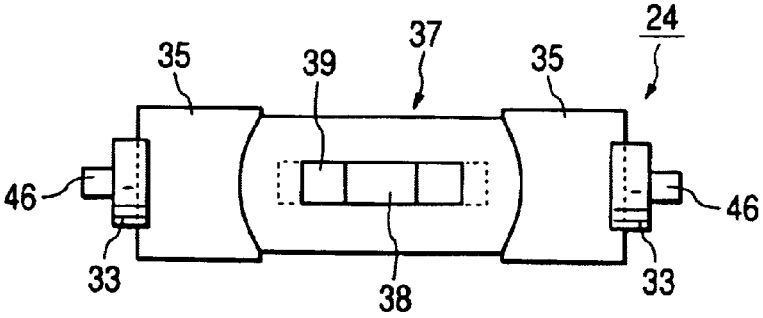
FIG. 6D is a bottom view of the second crank.

One of coupling portions 46 shown in FIGS. 1 and 6A to 6D is coupled to a variable resistor 47. Similarly, one of coupling portions 48 shown in FIGS. 5A to 5C is connected to a variable resistor (not shown).

Now, operation of the joy stick 20 will be described. As shown in FIG. 1, the operating stick 40 is grasped and tilted to the left and the right in a direction of an arrow B (or an arrow D in FIG. 3) thereby to rotate the first crank 23, and the angle of the rotation is detected by the variable resistor (not shown). In the same manner, the operating stick 40 is tilted back and forth in a direction of an arrow C (or an arrow E in FIG. 3) thereby to rotate the second crank 24, and the angle of the rotation is detected by the variable resistor 47.

By releasing the grasp of the operating stick 40, the first crank 23 and the second crank 24 are restored to a neutral position as shown in FIG. 1 by resilient restoring force of the helical spring 27. On this occasion, the spring holder 26 which swings following compressive restoring action of the helical spring 27 always resiliently abuts against the flat face portions 32*a* of the first crank 23 and the flat face portions 35 of the second crank 24 respectively to rotate the first crank 23 and the second crank 24. Therefore, an angle of the restoration will be constant, irrespective of engaging accuracy or progress of wear of the first crank 23 and the second crank 24 with respect to the operating stick 40.

In the meantime, the cams and pins which have been incorporated in the related joy stick are not required for assembling the joy stick of the present invention, and further, because the assembling work can be conducted from only one direction as shown in FIG. 2, the joy stick can be easily assembled and number of the components will be decreased.

When manufacturing the components, because the engaging accuracy and wear of the first crank 23 and the second crank 24 with respect to the operating stick 40 will not badly affect the restoring accuracy, it will be possible to loosen the engaging accuracy, and production and quality control will be made easier. Further, because the spring holder 26 and the flat face portions 32*a,* 35 are tightly brought into face-to-face contact with each other and will not slide, it will be possible to improve operability of the operating stick 40. Thus, it will be possible to decrease the resilient restoring force of the helical spring 27, and the joy stick 20 can be made compact as small as possible.

Although in the above described embodiment, the invention has been described referring to an example in which the variable resistors are employed as detecting means for detecting the rotation angles of the upper and the lower cranks, the detecting means should not be restricted to the variable resistor, but may be an encoder of a rotary type, for example.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A joy stick, comprising:

an operating stick having at its distal end a head with a groove;

a first crank; having a guide groove which supports the operating stick so as to be pivotable in a first direction;

first flat faces, which are formed at lower both end portions in a second direction perpendicular to the first direction;

a second crank; having a groove and a shaft which supports the operating stick so as to be pivotable in the second direction, the groove in the distal end of the operating stick engaging the shaft of the second crank;

second flat faces, which are formed at lower both end portions in the first direction;

a restoration member, which is arranged coaxially with the operating stick which is situated at a neutral position thereof, the restoration member including a flat top face brought into contact with the first flat faces and the second flat faces; and a spring member, which is arranged coaxially with the restoration member, the spring member urging the restoration member toward the first flat faces and the second flat faces.

2. The joy stick of claim 1, wherein the restoration member further has an annular groove formed in a lower face and the spring member is retained in the annular groove of the restoration member.

3. The joy stick of claim 1, wherein the second crank is provided with a connecting portion coupling both end portions, the shaft being provided at a center of the connecting portion, and an arcuate groove being formed in the connecting portion around an outer circumference of the shaft, the head at the distal end of the operating stick being received in the arcuate groove.

* * * * *